US012584631B2

(12) United States Patent
Gebel et al.

(10) Patent No.: US 12,584,631 B2
(45) Date of Patent: Mar. 24, 2026

(54) NOZZLE ASSEMBLY WITH A CENTRAL FUEL PIPE THAT IS SEALED AGAINST AN IN-FLOW OF AIR

(71) Applicant: Rolls-Royce Deutschland Ltd & Co KG, Blankenfelde-Mahlow (DE)

(72) Inventors: Gregor Christoffer Gebel, Ludwigsfelde (DE); Carsten Clemen, Mittenwalde (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 0 days.

(21) Appl. No.: 18/845,814

(22) PCT Filed: Mar. 21, 2023

(86) PCT No.: PCT/EP2023/057214
§ 371 (c)(1),
(2) Date: Sep. 10, 2024

(87) PCT Pub. No.: WO2023/180320
PCT Pub. Date: Sep. 28, 2023

(65) Prior Publication Data

US 2025/0198623 A1 Jun. 19, 2025

(30) Foreign Application Priority Data

Mar. 24, 2022 (DE) ..... 10 2022 202 936.4

(51) Int. Cl.
*F23R 3/28* (2006.01)
*F23D 11/38* (2006.01)
(Continued)

(52) U.S. Cl.
CPC ..... *F23R 3/28* (2013.01); *F23D 11/383* (2013.01); *F23D 11/406* (2013.01);
(Continued)

(58) Field of Classification Search
CPC .... F23D 11/383; F23D 11/406; F23D 11/408; F23D 14/20; F23D 14/24; F23D 14/48;
(Continued)

(56) References Cited

U.S. PATENT DOCUMENTS 3,691,765 A 9/1972 Carlisle
4,170,108 A 10/1979 Mobsby
(Continued)

FOREIGN PATENT DOCUMENTS

CN 103672969 A 3/2014
DE 1062873 B 8/1959
(Continued)

OTHER PUBLICATIONS

German Search Report dated Nov. 18, 2022 from counterpart German App No. 10 2022 202 936.4.
(Continued)

*Primary Examiner* — Kyle Robert Thomas
(74) *Attorney, Agent, or Firm* — SHUTTLEWORTH & INGERSOLL, PLC; Timothy J. Klima

(57) ABSTRACT

The invention relates to a nozzle assembly for a combustor of an engine, including at least one nozzle for injecting fuel into a combustion chamber of the combustor, wherein the nozzle has a nozzle main body which extends along a nozzle longitudinal axis and a nozzle holder connected to the nozzle main body and having at least one fuel supply line. The nozzle main body comprises a central fuel pipe extending along the nozzle longitudinal axis and sealed against an in-flow of air, in which fuel supplied via the at least one fuel supply line can be guided within the nozzle main body up to a fuel outlet opening of the fuel pipe provided at a nozzle end of the nozzle, via which the fuel can be introduced into the combustion chamber.

28 Claims, 12 Drawing Sheets

(51) Int. Cl.

| | |
|---|---|
| ***F23D 11/40*** | (2006.01) |
| ***F23D 14/20*** | (2006.01) |
| ***F23D 14/24*** | (2006.01) |
| ***F23D 14/48*** | (2006.01) |
| ***F23D 14/58*** | (2006.01) |
| ***F23R 3/04*** | (2006.01) |
| ***F23R 3/10*** | (2006.01) |
| ***F23R 3/12*** | (2006.01) |
| ***F23R 3/14*** | (2006.01) |
| ***F23R 3/26*** | (2006.01) |

(52) U.S. Cl.
CPC ..... *F23D 11/408* (2013.01); *F23D 14/20* (2013.01); *F23D 14/24* (2013.01); *F23D 14/48* (2013.01); *F23D 14/58* (2013.01); *F23R 3/04* (2013.01); *F23R 3/10* (2013.01); *F23R 3/12* (2013.01); *F23R 3/14* (2013.01); *F23R 3/26* (2013.01); *F23R 3/283* (2013.01)

(58) Field of Classification Search
CPC .... F23D 14/58; F23R 3/04; F23R 3/10; F23R 3/12; F23R 3/14; F23R 3/26; F23R 3/28
See application file for complete search history.

(56) References Cited

U.S. PATENT DOCUMENTS

| | | | | |
|---|---|---|---|---|
| 4,327,547 | A | 5/1982 | Hughes | |
| 4,342,198 | A | 8/1982 | Willis | |
| 4,483,138 | A | 11/1984 | Willis | |
| 4,713,938 | A | 12/1987 | Willis | |
| 4,842,509 | A | 6/1989 | Hasenack | |
| 5,117,637 | A | 6/1992 | Howell | |
| 5,636,511 | A | 6/1997 | Pfefferle | |
| 6,289,676 | B1 * | 9/2001 | Prociw | F23C 7/002 60/740 |
| 9,182,124 | B2 * | 11/2015 | Oskam | F23D 14/22 |
| 9,488,108 | B2 | 11/2016 | Ryon | |
| 10,655,842 | B2 | 5/2020 | Bjorklund | |
| 11,149,950 | B2 * | 10/2021 | Niemeyer | F02M 61/162 |
| 2012/0151928 | A1 * | 6/2012 | Patel | F23R 3/36 60/737 |
| 2012/0292408 | A1 | 11/2012 | Short | |
| 2019/0162414 | A1 * | 5/2019 | Ogata | F23R 3/286 |
| 2021/0348560 | A1 | 11/2021 | Dai et al. | |
| 2023/0213194 | A1 | 7/2023 | Naik | |
| 2023/0266012 | A1 | 8/2023 | Kool | |

FOREIGN PATENT DOCUMENTS

| | | | |
|---|---|---|---|
| DE | 2910464 | A1 | 9/1979 |
| DE | 10201558 | A1 | 8/2002 |
| DE | 10314941 | A1 | 10/2004 |
| DE | 102004059679 | A1 | 7/2005 |
| EP | 2515042 | A2 | 10/2012 |
| EP | 2870345 | A1 | 5/2015 |
| GB | 2593123 | A | 9/2021 |
| WO | 01556646 | A1 | 8/2001 |

OTHER PUBLICATIONS

Ruud Eggels—U.S. Appl. No. 18/838,958, filed Aug. 15, 2024.
Gregor Christoffer Gebel—U.S. Appl. No. 18/845,814, filed Sep. 10, 2024.
European Office Action dated Aug. 27, 2025 from counterpart European App No. 23713860.7.
International Search Report and Written Opinion dated Sep. 22, 2023 from counterpart International Patent Application No. PCT/EP2023/057208.
German Search Report dated Nov. 22, 2022 from counterpart German Patent Application No. 10 2022 202937.2.
European Office Action dated Oct. 21, 2025 from counterpart European App No. 23713859.9.

* cited by examiner

NOZZLE ASSEMBLY WITH A CENTRAL FUEL PIPE THAT IS SEALED AGAINST AN IN-FLOW OF AIR

This application is the National Phase of International Application PCT/EP2023/057214 filed Mar. 21, 2023 which designated the U.S.

This application claims priority to German Patent Application No. 102022202936.4 filed Mar. 24, 2022, which application is incorporated by reference herein.

DESCRIPTION

The proposed solution concerns a nozzle assembly for a combustion chamber of an engine having at least one nozzle for injection of gaseous fuel, in particular hydrogen, into a combustion space of the combustion chamber.

Nozzle assemblies for combustion chambers of engines are well known in a wide variety of embodiments. Hitherto conventional nozzles of such nozzle assemblies have focused on the injection of fuels where, in particular in the case of gaseous fuels, mixing of the fuel with air takes place already within the nozzle, in order to thus generate a combustible fuel-air mixture directly downstream of the nozzle end. By contrast, in applications involving operation with liquid fuels, for example kerosene or diesel, the air flow through the nozzle is commonly used to atomize (or at least assist the atomization of) the fuels to form sprays within the nozzle or directly downstream thereof. Typically, in both of the aforementioned approaches, the air that is to be admixed has swirl imparted to it already within the nozzle, such that a swirling fuel-air flow with turbulence and recirculation, which is considered to be advantageous for combustion, is created downstream of the nozzle end.

More recently, concepts for aircraft engines have increasingly been developed in which the engine is operated partially or entirely with hydrogen or other fuels that are to be injected in gaseous form, as is envisaged for example in U.S. Pat. No. 4,713,938 A1 for a gas turbine for power generation. However, if it is then intended to operate an engine for example with hydrogen instead of kerosene or diesel whilst maintaining the same design as far as possible, a different injection configuration is necessary, because the fuel is introduced into the combustion space in gaseous form and, for example in the case of hydrogen, also exhibits considerably shorter ignition delay times and higher flame speeds.

Against this background, the nozzle assembly disclosed herein is proposed, which comprises in particular a nozzle for injecting hydrogen into the combustion space of a combustion chamber of an engine, but which is also suitable for the injection of other fuels, in particular gaseous fuels.

Here, a proposed nozzle assembly comprises a nozzle having a nozzle main body, which comprises a central fuel pipe extending along the nozzle longitudinal axis and sealed against an inflow of air. In the fuel pipe, fuel supplied via at least one fuel feed line to a nozzle holder of the nozzle can be conducted inside the nozzle main body up to a fuel outlet opening of the fuel pipe provided at a nozzle end of the nozzle, via which the fuel can be introduced into the combustion space.

The fuel can be introduced into the nozzle without mixing with air in the combustion space, via the fuel pipe which is sealed against an inflow of air and extends centrally in the nozzle main body along the nozzle longitudinal axis. When the nozzle assembly is correctly installed in an engine, the nozzle-side fuel pipe is thus sealed against an inflow of air from a compressor stage of the engine, in particular at an upstream end of the nozzle main body. Thus in a nozzle of a proposed nozzle assembly, no premixing of fuel and air takes place inside the nozzle. This is advantageous in particular with regard to gaseous fuel to be injected, in particular highly flammable hydrogen, since the risk of flashback or premature auto-ignition of the fuel to be injected can be reduced. Thus in a nozzle of a proposed nozzle assembly, the fuel to be injected is only mixed with air for the first time downstream of the nozzle end. The fuel is not premixed with air inside the nozzle, so the fuel emerges from the nozzle end initially unmixed, and is only mixed with air (for combustion or mixing) downstream of the nozzle end.

In an embodiment variant, the nozzle comprises a feed reservoir which is connected to the fuel feed line and to which fuel can be supplied from the fuel feed line and from which fuel can be supplied to the fuel pipe. The feed reservoir is thus fluidically connected both to the fuel feed line and to the fuel pipe, so that the fuel coming from the fuel feed line can flow into the fuel pipe via the feed reservoir. The feed reservoir is here formed for example as a cavity in the nozzle holder or nozzle main body, e.g. as a cavity with annular cross-section, in particular in circle ring form or with circular cross-section. The feed reservoir can help ensure that the fuel is introduced into the fuel pipe as evenly as possible, for example by fuel flowing from the feed reservoir via multiple passage openings which are specifically arranged and e.g. evenly distributed.

For example, the feed reservoir is provided in a region of the nozzle which is bordered by an end wall lying upstream relative to a flow direction defined by the fuel pipe, along which the fuel is guided within the nozzle main body to the nozzle end. When the nozzle assembly is correctly installed in an engine, such an end wall faces away from the combustion space of the combustion chamber. For example, such an upstream feed reservoir is then formed in a head region of the nozzle main body which is connected to the nozzle holder. The fuel introduced into the fuel pipe from the feed reservoir can thus be conducted in the fuel pipe to the fuel outlet opening over a comparatively large part (more than 60%) of the length of the nozzle main body measured along the nozzle longitudinal axis. Thus the fuel can be conducted to the nozzle end in a targeted fashion, for example with homogenization of the fuel flow, in some cases with targeted swirling of the fuel flow.

At least one passage opening, via which the fuel can flow into the fuel pipe from the feed reservoir, may for example be configured for a radially inward inflow of fuel into a first pipe portion of the fuel pipe. Thus via the at least one passage opening, a substantially radially inwardly directed flow into the first pipe portion of the fuel pipe is possible. Accordingly, one or more fluidic connections provided by the one or more passage openings are provided between the feed reservoir and the fuel pipe, via which fuel can flow from the feed reservoir substantially radially inward into the first pipe portion and hence into the fuel pipe.

The at least one passage opening may here extend through an inner wall of the fuel pipe running around the nozzle longitudinal axis and bordering the first pipe portion. In this context, it may also be provided that the feed reservoir is configured as a ring chamber extending around the first pipe portion, so that fuel can flow from the ring chamber into the first pipe portion through one or more passage openings which are provided in the inner wall bordering the first pipe portion. In principle, a passage opening may be formed for example by a continuous hole or continuous slot.

Alternatively to a substantially radial inflow of fuel from the feed reservoir into the fuel pipe, also at least one passage opening may be configured for an inflow of fuel into a first pipe portion of the fuel pipe in a substantially axial direction. Here for example, the at least one passage opening may extend through a rear wall of the fuel pipe which runs substantially or precisely perpendicularly to the nozzle longitudinal axis and borders (delimits) the first pipe portion (upstream), or through a partition wall separating the feed reservoir from the first pipe portion.

Irrespective of whether a fuel inflow into the fuel pipe via one or more passage openings takes place substantially radially or substantially in the axial direction, one or more of the passage openings may be configured and provided for generating a fuel flow in the first pipe portion with a movement component in a circumferential direction around the nozzle longitudinal axis. A fuel flow with a movement component in the circumferential direction means that the fuel flow introduced into the fuel pipe is generated with a swirl caused by the form and/or orientation of the passage opening.

In the case of a passage opening provided for a substantially radial inflow of fuel into the first pipe portion of the fuel pipe, this may be achieved for example if the at least one passage opening extends through the inner wall in an extent direction which, relative to the nozzle longitudinal axis (in a cross-sectional view perpendicularly to the nozzle longitudinal axis), runs obliquely or with parallel offset to a radial line oriented radially to the nozzle longitudinal axis. Because of the resulting sloping course of the passage opening within the surrounding circumferential inner wall, a fuel flow generated thereby in the first pipe portion of the fuel pipe has a flow proportion in the circumferential direction and hence a swirl. In other words, the passage openings are not each arranged radially to the nozzle longitudinal axis and hence to a centre axis of the fuel pipe, but are angled with parallel offset to the radial lines or relative to the radial lines, within a cross-section perpendicular to the nozzle longitudinal axis (wherein they do not point to the nozzle longitudinal axis or a centre point of the first pipe portion visible in cross-sectional view).

In the case of one or more passage openings which are provided for a substantially axial inflow of fuel into the first pipe portion of the fuel pipe, the one or more passage openings may again extend in an extent direction through the (upstream) rear wall or the partition wall (isolating the fuel reservoir) which runs obliquely to the nozzle longitudinal axis. A passage opening in the rear wall or partition wall thus does not run parallel to the nozzle longitudinal axis, so a fuel flow generated by the passage opening in the first pipe portion also has a flow proportion in the circumferential direction. Naturally, in such an embodiment variant, for a (more) even inflow of fuel via a cross-section of the fuel pipe at the first pipe portion, again multiple passage openings may also be provided on the rear wall or partition wall, in particular evenly distributed along one or more circumferential directions around the nozzle longitudinal axis.

In a refinement of a proposed nozzle assembly, in which fuel can flow into a first pipe portion of the fuel pipe via multiple passage openings arranged on an inner wall, it is provided to allow differently sized mass flows of fuel to flow through the feed reservoir to the passage openings, in order to homogenize the partial mass flows of fuel flowing through the passage openings over the circumference of the first pipe portion. The aim here is to divide the total mass flow of fuel such that the same mass flow proportions of the total mass flow enter the first pipe portion through all passage openings. Here for example, the geometries of the passage openings will differ depending on how far the respective passage opening lies away from a feed opening, how many passage openings lie between the respective passage opening and the feed opening, and how many passage openings follow downstream (of the fuel reservoir) the respective access opening via which the fuel enters the feed reservoir from the fuel feed line. Thus for example at least two of multiple passage openings may differ from one another in their lengths (measured along a respective extent direction through the inner wall) and/or with respect to their cross-sectional areas. The phrase "different cross-sectional areas" includes in particular that at least two of multiple passage openings differ from one another with respect to their width measured in a circumferential direction and/or their depth measured in an axial direction running parallel to the nozzle longitudinal axis. This includes in particular that, if the passage openings have circular cross-sections, these differ from one another with respect to their diameter.

In principle, the feed reservoir may be configured as a ring chamber, in particular a circular ring chamber. The feed reservoir may thus be configured for example as a cavity with annular cross-section which extends around the first pipe portion for a substantially radial inflow of fuel into the fuel pipe, or is provided upstream of the first pipe portion in the case of a substantially axial inflow of fuel into the fuel pipe.

If the feed reservoir is configured as a ring chamber, for the above-mentioned homogenization of partial mass flows of fuel over the circumference of the ring chamber, it may be provided that the ring chamber tapers in cross-section towards a portion of a wall which borders the ring chamber on the radial outside, said portion lying opposite a feed opening via which the fuel can be supplied from the fuel feed line to the ring chamber. In a cross-sectional view, thus a width of the ring chamber reduces starting from the feed opening towards the (wall) portion opposite the feed opening, or towards an opposite side. The ring chamber thus has a greatest width in the region of the feed opening, and a smallest width opposite this. In principle, a ring chamber with a width changing over the circumference in cross-sectional view may also be combined with nozzle outlet openings which differ from one another with respect to their length and/or cross-sectional areas, and/or which run obliquely in the inner wall of the first pipe portion in order to generate a swirling fuel flow into the fuel pipe. The tapering of the ring chamber may in principle be caused in particular by a change in wall thickness over the circumference of the inner first pipe portion—in the region of the feed reservoir—and/or a change in wall thickness over the circumference of the wall bordering the ring chamber on the radial outside. Thus for example the wall thickness of the inner first pipe portion may increase in cross-section (radially outward) towards the portion of the radially outer bordering wall lying opposite the feed opening, and/or the wall thickness of the wall may increase (radially inward) towards the portion lying opposite the feed opening, in order to provide a ring chamber which tapers in cross-sectional view.

Irrespective of whether or not passage openings with different cross-sectional areas are used in combination with a ring chamber tapering in cross-sectional view, it may be provided that the cross-sectional areas of multiple passage openings increase, and thus become larger, over the circumference of the ring chamber starting from a first passage opening to at least one further passage opening. The first passage opening here faces a feed opening, or the first passage opening lies at least downstream of the feed line via which fuel can be supplied from the fuel feed line to the ring chamber. The at least one further passage opening again faces a portion of a wall bordering the ring chamber on the radial outside and situated, in cross-sectional view, at the furthest downstream position viewed from the feed opening. In a cross-sectional view therefore, the cross-sectional areas are larger for passage openings which follow the first passage opening in a clockwise or counter-clockwise direction. Thus the fuel can be introduced into the first pipe portion through passage openings lying further away from the feed opening with smaller pressure loss, so that substantially the same mass of fuel enters the first pipe portion per time unit via all passage openings when fuel is supplied to the nozzle.

Instead of forming the feed reservoir as a ring chamber, in an alternative design variant the feed reservoir is formed via a hollow body arranged centrally upstream of the first pipe portion. The fuel can then flow into the first pipe portion of the fuel pipe substantially axially from a corresponding central cavity, e.g. in the head region of the nozzle main body, where applicable through one or more passage openings as explained above. As already mentioned above, here one or more of the passage openings may be configured and provided for generating a fuel flow in the first pipe portion with a movement component in a circumferential direction around the nozzle longitudinal axis. For this, the passage openings are arranged e.g. running not axially to the nozzle longitudinal axis, but at an angle. Centre axes (in particular bore axes) of the passage openings then for example run tangentially to a theoretical circle about the nozzle longitudinal axis.

In one embodiment variant, inside the fuel pipe, at least one centrally arranged flow body is provided, along the outer casing surface of which the fuel supplied to the fuel pipe can flow. Fuel may flow for example axially around such a centrally arranged flow body, which thus serves to improve homogenization of the fuel flow within the fuel pipe and/or influence the flow direction of the fuel at the fuel outlet opening.

In principle, one end of a flow body arranged inside the fuel pipe may extend up to the nozzle end and thus in particular up to the fuel outlet opening. For example, the flow body at the nozzle end may here protrude axially beyond an edge of the fuel outlet opening lying radially further out, i.e. protrude slightly axially beyond the edge of the fuel outlet opening. An end of the flow body may here define a flow direction for the fuel to be injected into the combustion space. For example, for this the flow body may have at its end a guide element, via which fuel emerging at the fuel outlet opening is conducted radially outward relative to the nozzle longitudinal axis. For example, at the end of the flow body, the guide element is formed by a radial widening of the flow body. The injection of fuel into the combustion space with a flow proportion pointing radially outward may here influence the properties, e.g. shape and size, of a flow field of a recirculation zone occurring downstream of the nozzle end, which may be advantageous in particular for gaseous fuel and in particular hydrogen with respect to flame stability and comparatively low combustion temperatures in the immediate vicinity of the nozzle.

Furthermore, a targeted acceleration of the fuel flow into the combustion space may be achieved via a narrowing at the end of the fuel pipe at the fuel outlet opening, which is implemented via the end of the flow body facing the combustion space.

In principle, the flow body may take the form of a peg or cone.

Alternatively or additionally, the flow body is formed symmetrical, in particular rotationally symmetrical to the nozzle longitudinal axis and/or with a blunt or substantially flat, centrally arranged end facing the combustion space. A blunt or substantially flat, centrally arranged face on an end of the flow body may for example support the formation of an inner recirculation zone with comparatively high fuel concentration during operation of the combustion chamber or engine. Such an inner recirculation zone is however accompanied by lower combustion temperatures in the vicinity of the nozzle and hence immediately downstream of the nozzle end.

In principle, the flow body may have an upstream end with a convex curvature, which may also be formed aerodynamically and is axially spaced from an end wall of the nozzle or a rear wall of the fuel pipe. Depending in particular on the design of the feed reservoir, in some embodiments variants of the proposed solution, the flow body may also be combined with an end wall of the nozzle or a rear wall of the fuel pipe. Here, the flow body then extends away from the end wall or rear wall along the nozzle longitudinal axis, and is therefore not axially spaced from the end wall or rear wall. Whereas with an axial spacing of the flow body, the flow body has an upstream end inside the fuel pipe onto which fuel flows axially, this is not the case with a flow body connected to the end wall or rear wall. Depending on design and peripheral conditions, either form of the flow body may be advantageous, e.g. with respect to an achievable thickness of the nozzle main body in a head region of the nozzle main body.

In an embodiment variant, two flow bodies may be present inside the fuel pipe, which are axially spaced apart relative to the nozzle longitudinal axis. In such an embodiment variant, between the two flow bodies, there is accordingly a central pipe portion of the fuel pipe through which fuel can flow over the entire cross-section. For example, a first upstream flow body may be peg-shaped, while a further flow body provided downstream in the region of the fuel outlet opening may be conical or otherwise aerodynamically favourable in shape, e.g. hemispherical, conical (with blunt or rounded cone tip), ogival or ovoid.

At its nozzle end, the nozzle may comprise a nozzle head which is connected to the nozzle main body and has at least one air duct, via which air provided for mixing with the fuel delivered from the fuel outlet opening can be introduced into the combustion space. Thus, on the nozzle head, at least one air-guiding duct is provided which lies radially outside relative to the inner or central fuel pipe.

At the nozzle end, the air-guiding duct may comprise at least one air outlet opening, wherein the fuel outlet opening of the fuel pipe protrudes axially relative to the at least one air outlet opening of the air-guiding duct, with respect to the nozzle longitudinal axis. Thus, in a flow direction defined by the fuel pipe, along which the fuel is guided inside the nozzle main body, the fuel outlet opening lies at least as far or further downstream than the at least one air outlet opening of the air-guiding duct. In particular, in this context, it may be provided that the fuel outlet opening is arranged furthest downstream, i.e. each air outlet opening is set back axially, with respect to the nozzle longitudinal axis, relative to the fuel outlet opening of the fuel pipe. In this way, fuel can be injected into the combustion space further downstream than air via the at least one air-guiding duct situated radially to the outside. This assists in achieving that the release of heat owing to combustion of the mixture of fuel and air that is created downstream of the nozzle does not place a critical thermal load on the nozzle.

In an embodiment variant, also at least two air-guiding ducts, which are radially spaced apart and each have at least one air outlet opening, are provided at the nozzle head. Via at least one swirling air flow from one (e.g. at least a radially outermost air-guiding duct) or both of two air-guiding ducts radially offset to one another at the nozzle head, an air flow can be created at the nozzle end which surrounds the fuel flow, draws it radially outward and hence generates a recirculation zone in which air and fuel mix, so as to form a swirl-stabilized, recirculating combustion zone. Here, the air that flows in via the air-guiding ducts serves to form an air-rich zone in a front region of the combustion chamber around the nozzle end (a so-called outer recirculation zone). The nozzle and a combustion chamber wall, surrounding the nozzle, of the combustion chamber can thus be thermally protected from the combustion zone.

To provide an adequate air flow rate via the nozzle, in particular for an above-mentioned outer recirculation zone, one or more radially inwardly pointing inlet lips may be provided at least at a radially outermost air-guiding duct of the at least two air-guiding ducts, in order to direct air into the radially outermost air-guiding duct. When the nozzle assembly is correctly installed, the one or more inlet lips thus for example also ensure that air, coming from a compressor stage and conducted around the nozzle main body, is conducted radially inward into the radially outermost air-guiding duct, and where applicable also into a further air-guiding duct lying radially further inward. The use of inlet lips for one or more air-guiding ducts may be advantageous in particular for a head region of the nozzle which is comparatively thick, and thus under some circumstances initially obstructs the axial inflow of a sufficiently large quantity of air into the air-guiding duct or ducts.

For the formation of an effective recirculation zone, tt may furthermore be advantageous if the air flow introduced into the combustion space via an air-guiding duct has a swirl. For example, for this purpose, one or more axial swirling means or radial swirling means are provided at least in a radially outermost air-guiding duct of the at least two air-guiding ducts.

As already explained initially, the proposed solution is particularly suitable for the injection of different types of fuel. With a view to the injection of gaseous fuel and in particular hydrogen, the central supply of fuel, supported before mixing with air, via a nozzle-side fuel pipe has particular advantages.

The proposed solution also comprises an engine having at least one embodiment variant of a proposed nozzle assembly. Naturally, a proposed nozzle assembly may however also be used in a (stationary) gas turbine.

The appended figures illustrate, by way of example, possible design variants of the proposed solution.

Figure 11A:
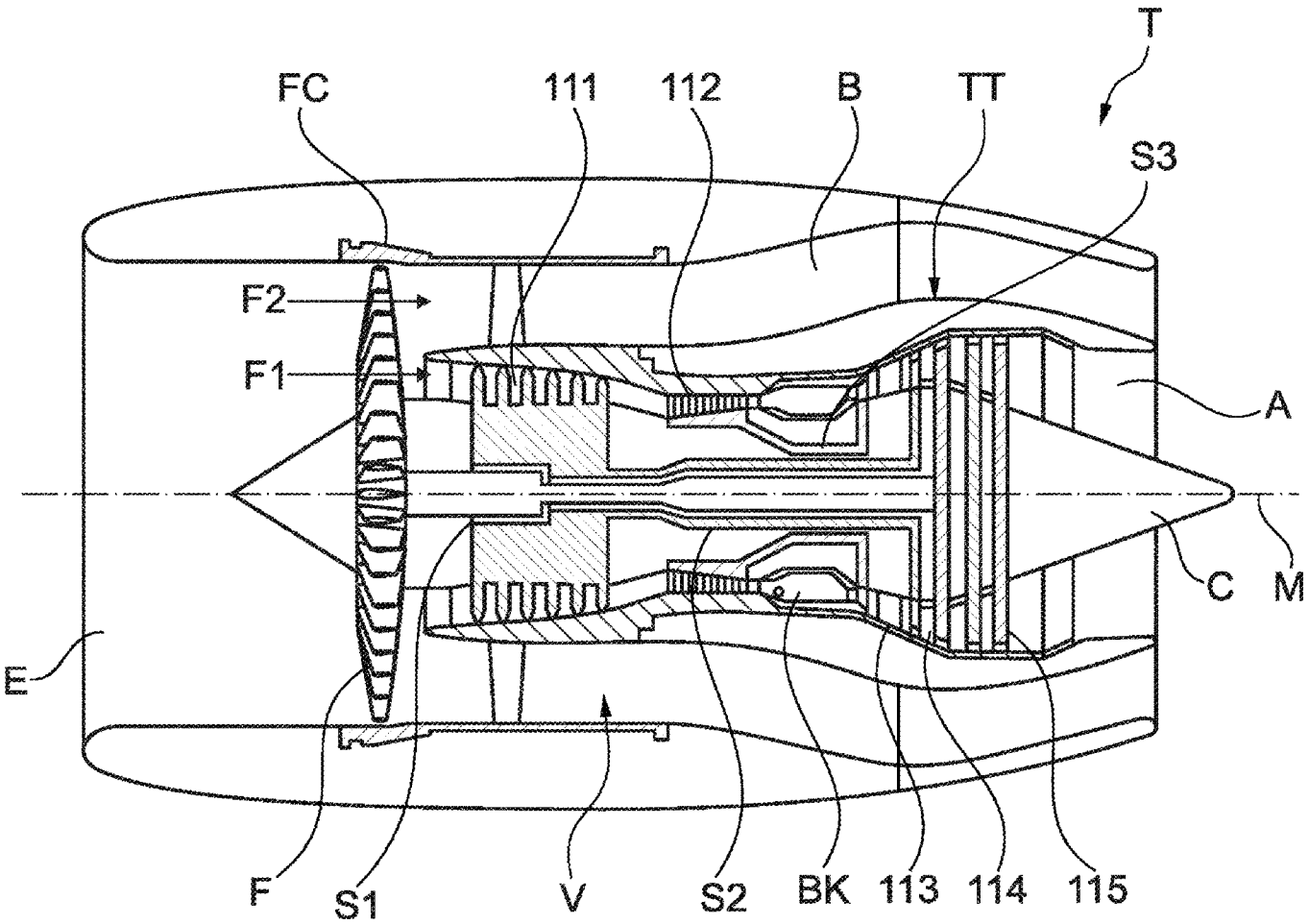
FIG. 11A shows an engine in which a design variant of a proposed nozzle assembly is used.

FIG. 11A depicts, schematically and in a sectional illustration, a (turbofan) engine T in which the individual engine components are arranged one behind the other along an axis of rotation or central axis M, and the engine T is in the form of a turbofan engine. At an inlet or intake E of the engine T, air is moved along an inlet direction, and compressed, by means of a fan F. This fan F, which is arranged in a fan casing FC, is driven by means of a rotor shaft S1 which is set in rotation by a turbine TT of the engine T. Here, the turbine TT adjoins a compressor V, which has, for example, an (optional) medium-pressure compressor 111 and a high-pressure compressor 112, and optionally also a low-pressure compressor (booster). The fan F conducts air both in a primary air flow F1 to the compressor V, and, in order to generate thrust, in a secondary air flow F2 to a secondary flow duct or bypass duct B. The bypass duct B extends around a core engine comprising the compressor V, the combustion chamber assembly BK and the turbine TT and comprising a primary flow duct for the air that is fed to the core engine by the fan F. The air that is conveyed into the primary flow duct by means of the compressor V enters a combustion chamber assembly BK of the core engine, in which thermal energy for driving the turbine TT is generated by combustion of fuel with air that flows in from the compressor V. For this purpose, the turbine TT has a high-pressure turbine 113, an (optional) medium-pressure turbine 114 and a low-pressure turbine 115. Here, the turbine TT drives the rotor shafts S1, S2 and S3 and thus the medium-pressure and high-pressure compressors and the fan F in order to generate thrust by means of the air that is conveyed into the bypass duct B. Both the air from the bypass duct B and the exhaust gas-air mixture from the primary flow duct of the core engine flow out via an outlet A at the end of the engine T, and both contribute to the total thrust of the engine. Here, the outlet A commonly has a thrust nozzle and a centrally arranged outlet cone C. Also widely used are designs in which, upstream of the exit through the outlet A, the air from the bypass duct and the exhaust-gas-laden air from the primary flow duct are merged to form one single air flow. To achieve this merging, lobed mixers are commonly used, which are arranged within the engine upstream of a common thrust nozzle and the outlet A (not shown).

Figure 11B:
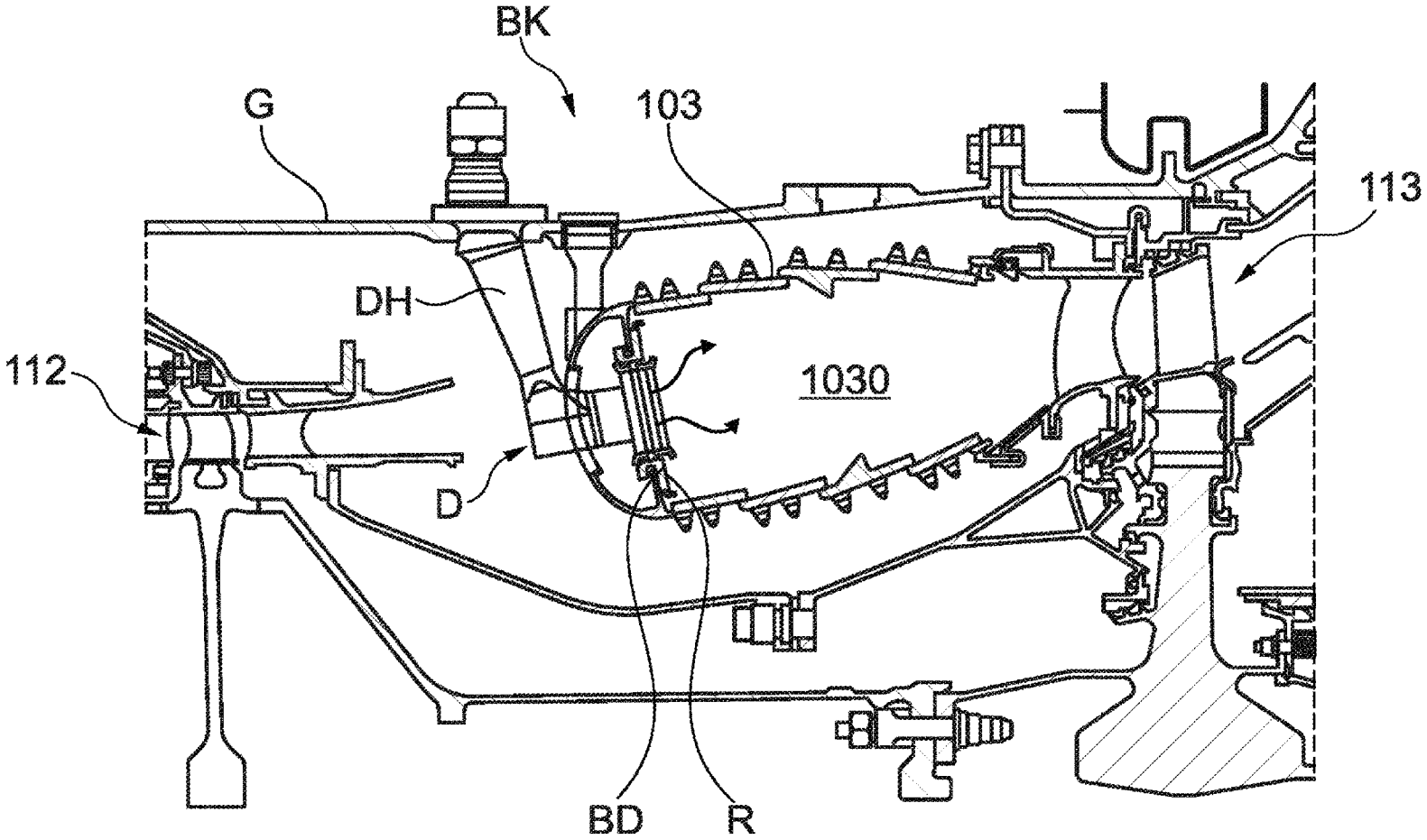
FIG. 11B shows, in extract and on an enlarged scale, the combustion chamber of the engine of FIG. 11A.

FIG. 11B shows a longitudinal section through the combustion chamber assembly BK of the engine T. This shows in particular an (annular) combustion chamber 103 of the engine T. A nozzle assembly is provided for the injection of fuel or an air-fuel mixture into a combustion space 1030 of the combustion chamber 103. Said nozzle assembly comprises a combustion chamber ring R on which multiple nozzles D are arranged at a combustion chamber head of the combustion chamber along a circular line around the central axis M. One or more combustor seals BD with mounting openings at which nozzle heads of the respective nozzles D are held are provided on the combustion chamber ring R, with the result that fuel can thereby be injected into the combustion chamber 103. Each nozzle D comprises a flange by way of which a nozzle bracket DH of the nozzle D is screwed to an outer casing G of the combustion chamber assembly BK.

Conventional nozzles D for an engine T are typically designed for injecting liquid fuel, such as kerosene or diesel, and for this purpose have a central first air-guiding duct, at least one further, second air-guiding duct situated radially to the outside, and a fuel-guiding duct that is provided between the two air-guiding ducts. Fuel that emerges at a fuel outlet opening of such a fuel-guiding duct is then mixed already at the nozzle with air from the first central air-guiding duct and optionally also with the air from the air-guiding duct situated radially further to the outside, such that a fuel-air mixture is provided at a nozzle end of the nozzle D.

Such a configuration of a nozzle D is disadvantageous under certain circumstances, in particular for fuel that is to be injected into a combustion space 1030 of the combustion chamber 1031 in gaseous form, in particular hydrogen. This is remedied by a nozzle assembly having a nozzle D according to the proposed solution, different design variants of which are illustrated in FIGS. 1 to 10B.

Here, provision is made in each case whereby, on a nozzle main body DR of the nozzle D, a central fuel pipe 3 is provided which extends along a nozzle longitudinal axis L and which is sealed off to prevent an inflow of air and via which fuel can be conducted within the nozzle main body DR to a fuel outlet opening 33 of the fuel pipe 3, which fuel outlet opening is provided at a nozzle end of the nozzle D. From the fuel outlet opening 33, the fuel can then be introduced into the combustion space 10301 in order to be mixed with air for the first time.

Figure 1:
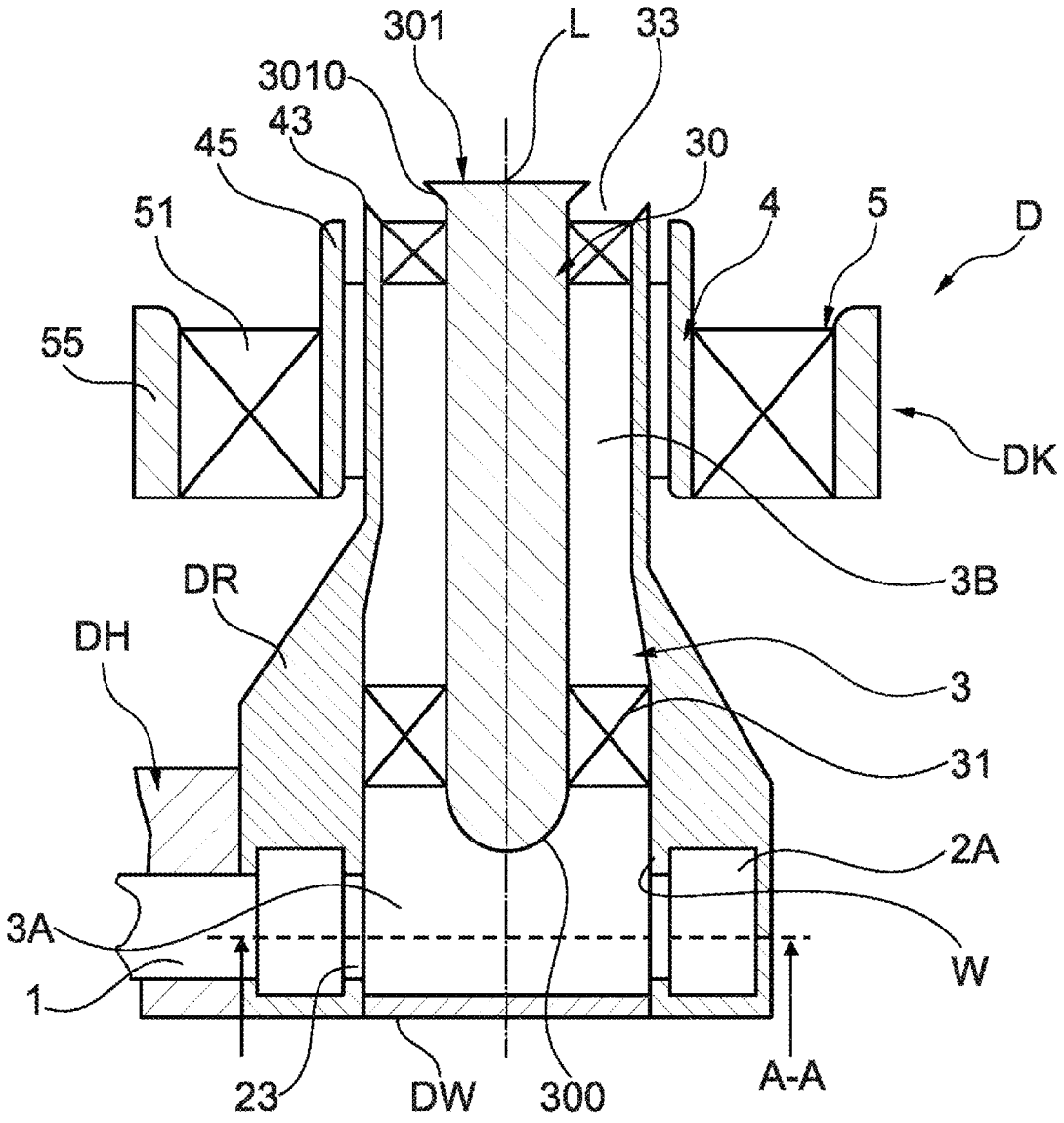
FIG. 1 shows, in extract and a sectional illustration, a first embodiment variant of a nozzle of a proposed nozzle assembly having a feed reservoir configured as a ring chamber, from which fuel can flow substantially radially inward into a central fuel pipe of a nozzle main body.

In a first design variant according to FIG. 1, the central fuel pipe 3 of a nozzle D is supplied with fuel via a feed line reservoir in the form of an annular chamber 2A. This annular chamber 2A extends, at a head region of the nozzle D that is connected to the nozzle bracket DH, annularly around a first pipe portion 3A of the fuel pipe 3, and is supplied with fuel via a fuel feed line 1 that extends in the nozzle bracket DH. Fuel from the fuel feed line 1 thus firstly passes via a feed opening of the fuel feed line 1 into the annular chamber 2A, from which the fuel can then flow into the first pipe portion 3A of the fuel pipe 3. Here, the fuel flows from the annular chamber 2A into the first pipe portion 3A substantially radially inwardly with respect to the nozzle longitudinal axis L via passage openings 23 that are distributed circumferentially on an inner wall W of the first pipe portion 3A.

At the end face averted from the combustion space 1030, the fuel pipe 3 is sealed off, by means of a continuous end wall DW of the nozzle D, with respect to air from the compressor V of the engine T. Fuel that is fed from the fuel feed line 1 into the fuel pipe 3 is furthermore also conveyed within the nozzle main body DR to the nozzle end of the nozzle D in unmixed form, that is to say without being mixed with air. Here, the fuel that is fed radially from the annular chamber 2A into the fuel pipe 3 flows in an axial direction from the first pipe portion 3A, which defines a prechamber within the fuel pipe 3, into a second pipe portion 3B that has a flow body 30 arranged centrally within the fuel pipe 3. The fuel flows along said flow body 30 to the fuel outlet opening 33 of the fuel pipe 3 at the end face of the nozzle.

In the present case, the central flow body 30 is of peg-like form, thus defining the second pipe portion 3B which in the present case is of annular cross section (and thus defining an annular space axially adjoining the first pipe portion 3A), in which second pipe portion the fuel is conducted along the nozzle longitudinal axis L to the fuel outlet opening 33. By means of the flow body 30, the fuel flow can be homogenized over the cross section. The flow body 30 furthermore has, at a downstream end 301, a guide collar 3010 which serves as a guide element and by means of which the nozzle outlet opening 33 is narrowed and deflects the emerging fuel flow radially outward.

The fuel thus injected is mixed with air for the first time within the combustion space 1030 downstream of the fuel outlet opening 33, said air being introduced into the combustion space 1030 via two air-guiding ducts 4 and 5 on a nozzle head DK of the nozzle D. Here, a first air-guiding duct 4 is formed as a relatively narrow annular gap on the nozzle head DK radially to the outside of the central fuel pipe 3. The further air-guiding duct 5 is provided radially further to the outside of this, as a radially outermost air-guiding duct, on the nozzle head DK. Air outlet openings of the two air-guiding ducts 4, 5 are in this case axially set back in relation to the fuel outlet opening 33, such that the end of the fuel pipe 3 and thus the fuel outlet opening 33 protrude axially, with respect to the flow direction of the fuel defined by the fuel pipe 3, beyond the air outlet openings of the two air-guiding ducts 4 and 5. Inner and outer walls 43 and 45 that border the first air-guiding duct 4 thus end further upstream than the fuel pipe 3. The same applies to an outermost wall 55, situated radially further to the outside, for the further, radially outermost air-guiding duct 5.

In the design variant of FIG. 1, swirl elements in the form of axial air-swirling means 51 are provided in the radially outermost air-guiding duct 5, which has a duct width several times greater than that of the first air-guiding duct 4. An swirling outer air flow is generated by these means.

A swirling fuel flow can likewise be generated by axial fuel-swirling means 31 within the second pipe portion 3B of the fuel pipe 3, which swirling fuel flow enters the combustion space 1030 at the fuel outlet opening 33. Consequently, in the design variant of FIG. 1, fuel that flows substantially radially from the annular chamber 2A via the passage openings 23 in the inner wall W into the fuel pipe 3, specifically the first pipe portion 3A thereof, will firstly flow onward in the direction of an upstream end 300, spaced from the end wall DW, of the pin-like flow body 30, and then be guided radially past the flow body 30 into the second pipe portion 3B of the fuel pipe 3 having the fuel-swirling means 31. The fuel flow that is guided on the flow body 30 over a major part of the length of the nozzle main body DR as measured along the nozzle longitudinal axis L remains unmixed as far as the exit at the fuel outlet opening 33, and it is only downstream of the nozzle D that said fuel flow impinges on the air flows from the two air-guiding ducts 4 and 5 situated radially further to the outside.

The central, sealed-off guidance of the fuel in the fuel pipe 3 is advantageous in particular for highly flammable hydrogen, in order to avoid instances of flashback and premature autoignition in the vicinity of the nozzle. The air flows supplied via the air-guiding ducts 4 and 5 furthermore ensure an advantageous recirculation zone in the combustion space 1030 downstream of the nozzle D. The proposed supply of fuel into the sealed central fuel pipe 3 is illustrated in more detail for a first possible embodiment variant in the sectional illustration of FIGS. 2A to 2C.

Figure 2C:
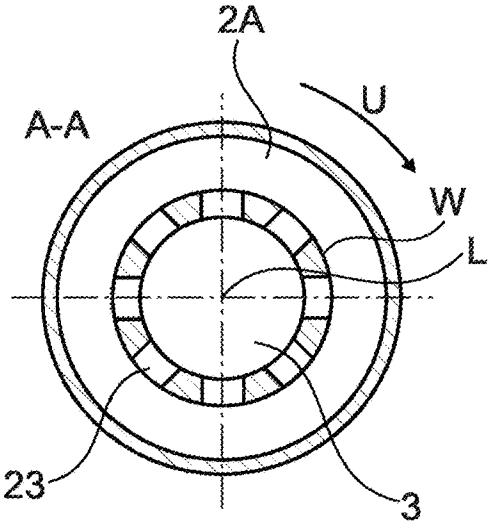
FIGS. 2A-2C show various sectional views along section line A-A from FIG. 1, illustrating different numbers of passage openings, via which the ring chamber is fluidically connected to the central fuel pipe.
Figure 2B:
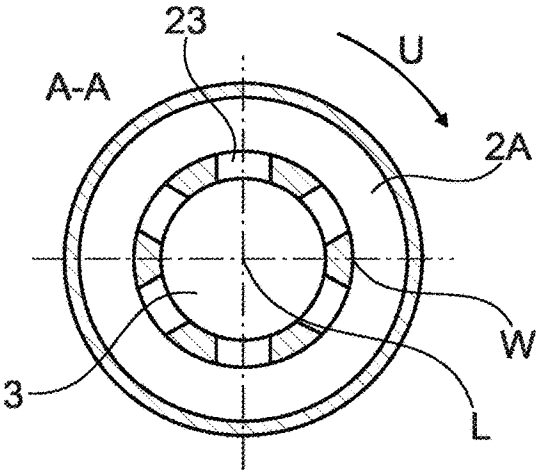
Figure 2A:
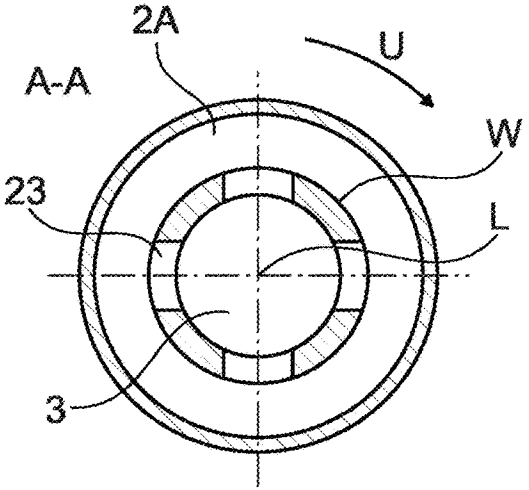
Figure 3C:
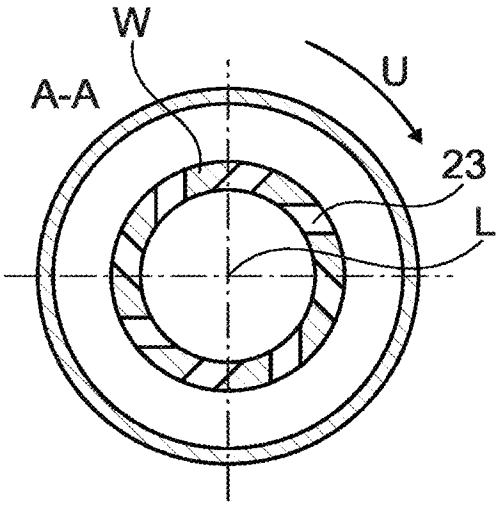
FIGS. 3A-3C show views, corresponding to FIGS. 2A-2C, of possible refinements for generating a swirling inflow of fuel into the fuel pipe via obliquely running passage openings.
Figure 3B:
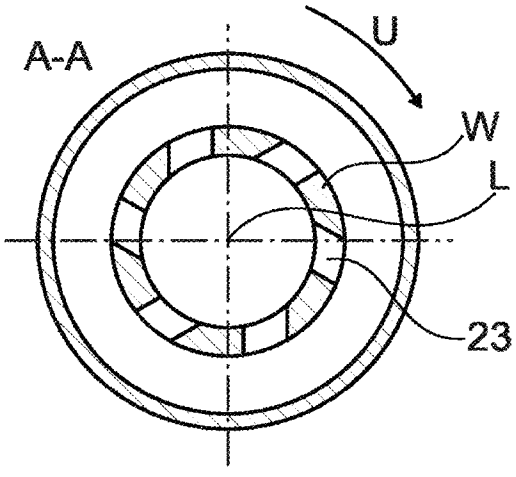
Figure 3A:
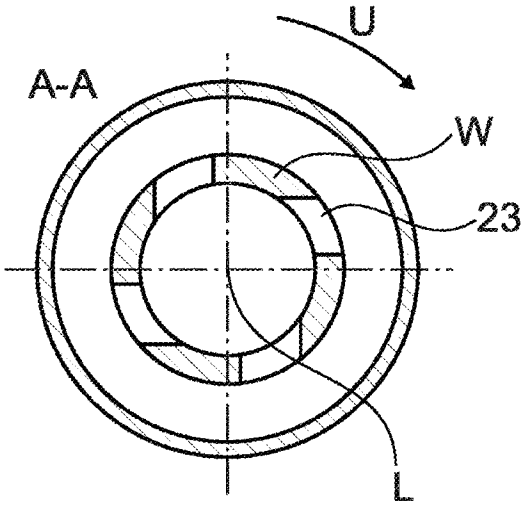

FIGS. 2A, 2B and 2C here each show a sectional view along the section line A-A from FIG. 1. They illustrate in particular a cross-section through the ring chamber 2A, the fuel pipe 3 in the region of the first pipe portion 3A, and the inner wall W separating the ring chamber 2A from the interior of the fuel pipe 3. Furthermore, the sectional illustration also shows the passage openings 23 evenly distributed over the circumference of the inner wall W.

FIGS. 2A, 2B and 2C illustrate as an example that different numbers of passage openings 23 may be provided, distributed over the circumference, in order to allow the fuel to flow from the ring chamber 2A into the fuel pipe 3 as evenly as possible. Thus in the illustration of FIG. 2A, four passage openings 23 are provided, the centre axes of which are offset to one another by 90°. In the embodiment variant of FIG. 2B however, six passage openings 23 are provided, the centre axes of which are offset to one another by 60°. The embodiment variant in FIG. 2C in turn shows eight passage openings distributed over the circumference, with centre axes offset to one another by 45°.

In the embodiment variants of FIGS. 2A to 2C, the centre axes of the passage openings 23 each run radially to the nozzle longitudinal axis L and hence along radial lines relative to the nozzle longitudinal axis L, so that fuel can only flow from the ring chamber 2A into the fuel pipe 3 substantially radially relative to the nozzle longitudinal axis L. It is however evidently also possible to create, already on inflow of the fuel into the fuel pipe 3, a flow proportion in the circumferential direction U in the respective inflow, so that a swirling fuel flow in the fuel pipe 3 occurs even in the first pipe portion 3A. According to the possible refinements in FIGS. 3A, 3B and 3C, for this it may for example be provided that the centre axes of the passage openings 23 run sloping or parallel-shifted (in the variants shown in FIGS. 3A to 3C) relative to the respective radial line (with respect to the nozzle longitudinal axis L). A passage opening 23 thus has an oblique extent through the inner wall W. A fuel flow guided through the respective passage opening 23 thus additionally has a flow proportion in the circumferential direction U, and hence a swirl, on entry into the fuel pipe 3. In some cases, swirling via fuel-swirling means 31 within the fuel pipe 3 may therefore be obsolete.

Figure 5:
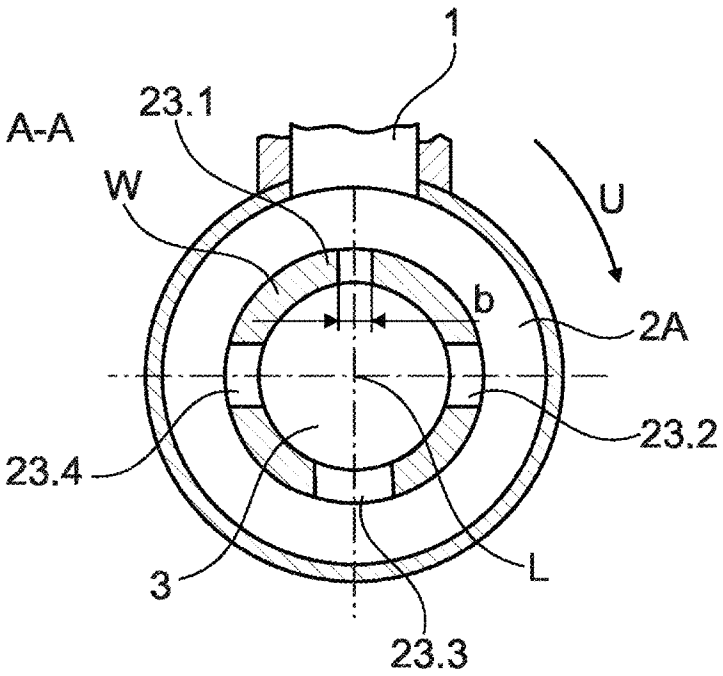
FIG. 5 shows, in a view corresponding to FIGS. 2A-2C, 3A-3C and 4, a further refinement in which the cross-sectional areas (with through-flow) of passage openings, distributed over the circumference for the inflow of fuel into the fuel pipe from the ring chamber, differ according to the position of a passage opening on the circumference of the combustion chamber.
Figure 4:
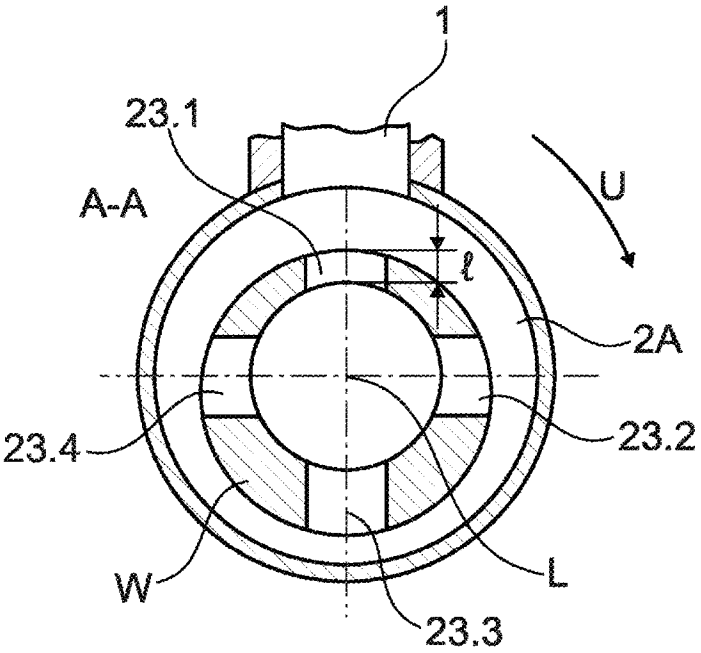
FIG. 4 shows, in a view corresponding to FIGS. 2A-2C and 3A-3C, a refinement in which the ring chamber is configured with tapering width in cross-sectional view.
Figure 6:
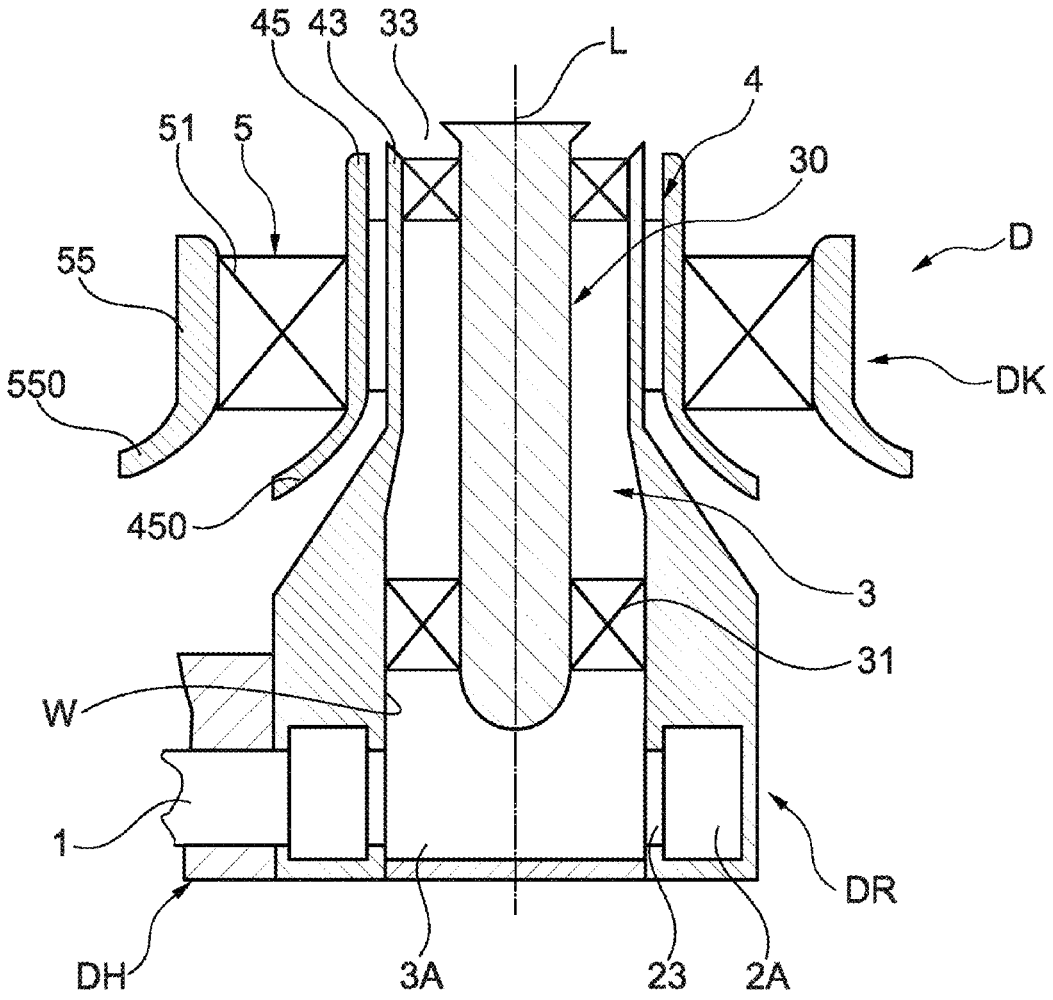
FIG. 6 shows, in a view corresponding to FIG. 1, a further embodiment variant in which inlet lips are formed on the radially outer air-guiding ducts of a nozzle head of the nozzle.

In the embodiment variants of FIGS. 4 and 5, furthermore a (greater) homogenization of the partial mass flows of fuel from the ring chamber 2A into the fuel pipe 3 is supported by further measures.

Thus the embodiment variant of FIG. 4 shows—as an example for four passage openings 23.1 to 23.4 distributed over the circumference—that the combustion chamber 2A is formed with gap width which changes over the circumference. For this for example, the wall thickness of the inner wall W varies over the circumference. This achieves that the ring chamber 2A tapers in cross-section towards a portion of a wall which borders the ring chamber 2A on the radial outside and lies opposite a feed opening, via which the fuel can be supplied from the fuel feed line 1 to the ring chamber 2A. This same effect can be achieved if the wall thickness of the outer wall varies and thickens radially towards the inside in the direction of the inner wall W. Evidently a combination of tapering inner and outer walls is also conceivable.

Then for example the ring chamber 2A, in the region of a first passage opening 23.1 lying opposite the feed opening for the fuel feed line 1, is provided in a region with maximum gap width of the ring chamber 2A In the cross-sectional view shown in FIG. 4, then clockwise and counter-clockwise in the direction of further passage openings 23.2 and 23.4 respectively, the gap width of the ring chamber 2A then reduces to a minimum gap width in the region of a passage opening 23.3. This passage opening 23.3 faces precisely the portion of the wall bordering the ring chamber 2A radially on the outside and lying opposite the feed opening. Because of the tapering ring chamber 2A and the increase in wall thickness of the inner wall W, selected for this in the present case, the lengths l of the passage openings 23.1-23.4, by which the passage openings 23.1-23.4 extend radially inward through the inner wall W, also vary.

In the variant of FIG. 5, the through-flow cross-sectional areas of passage openings 23.1-23.4 vary over the circumference of the inner wall W, depending on how far the respective passage opening 23.1-23.4 lies away from the feed opening for the fuel feed line 1. Thus a first passage opening 23.2 lying directly opposite the fuel feed line 1 has a smallest width b measured in the circumferential direction U, and hence the smallest cross-sectional area with through-flow. In contrast, the directly opposite passage opening 23.2 has the greatest width and hence the largest cross-sectional area with through-flow. If the passage openings 23.1-23.4 are formed with circular cross-section, the width b shown in the cross-sectional view of FIG. 5 corresponds to a diameter of the respective passage opening 23.1-23.4.

In principle, the passage openings 23 and 23.1-23.4 may be configured as holes or slots on the inner wall W.

In order to assist the supply of air into the air ducts 4 and 5 on the nozzle head DK of the nozzle D, one possible refinement according to FIG. 5 provides that inlet lips 450 and 550 are formed upstream on the outer wall 45 and on the outermost wall 55. Said inlet lips 450 and 550 cause air that flows from the compressor V past the nozzle main body DR to be targetedly conducted radially inward into the air-guiding ducts 4 and 5. It is thus possible in particular for a potentially disadvantageous admission of flow into the air-guiding ducts 4 and 5 owing to a relatively thick head region of the nozzle main body DR to be effectively countered, such that a sufficiently high air quantity nonetheless enters the air-guiding ducts 4 and 5.

Figure 7B:
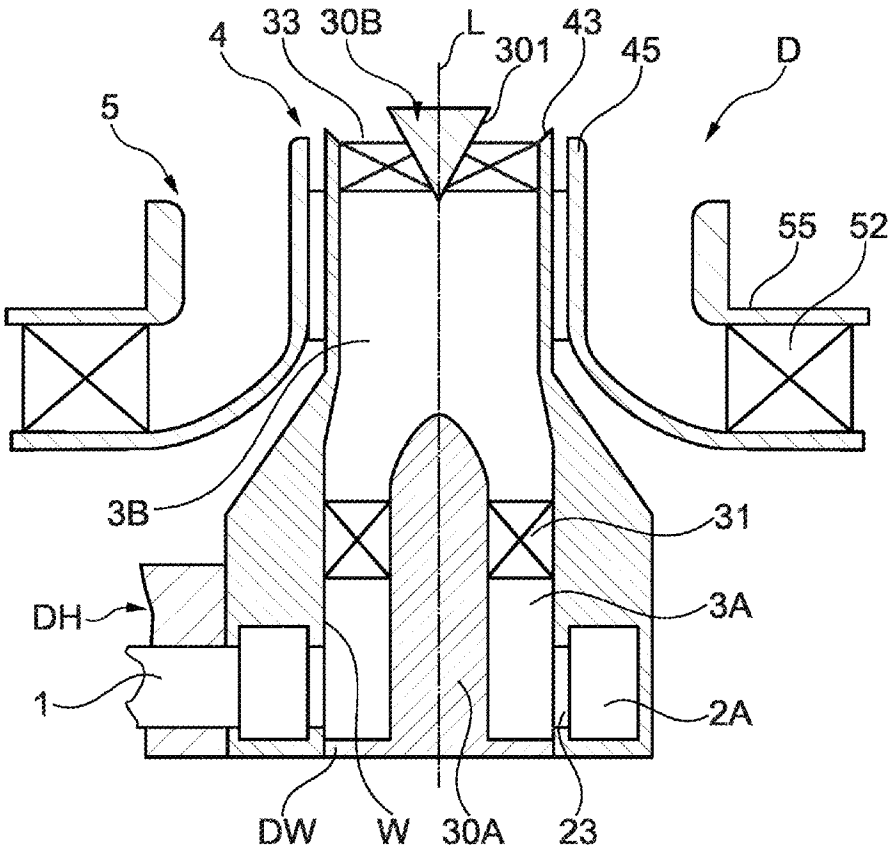
FIG. 7B shows a refinement of the embodiment variant of FIG. 7A in which, instead of an axial swirling means, a radial swirling means is provided in an axially outermost air-guiding duct of the nozzle head.
Figure 7A:
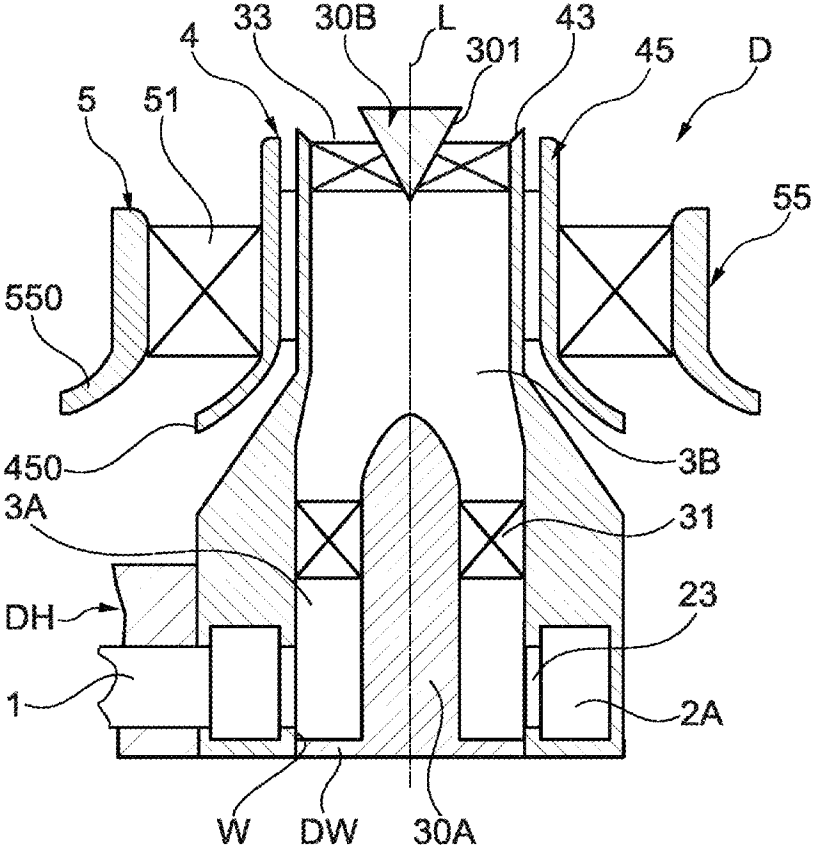
FIG. 7A shows, in a view corresponding to FIGS. 1 and 6, a refinement of the embodiment variant of FIG. 6 in which two axially spaced flow bodies (instead of one central flow body) are provided in the fuel pipe.

In an alternative embodiment variant in FIG. 7A, two flow bodies 30A and 30B axially offset to one another are provided inside the fuel pipe 3. The one (first) upstream peg-shaped flow body 30A is here guided up to the end wall DW and connected thereto. The first pipe portion 3A which the fuel reaches from the main chamber 2A thus surrounds the first flow body 30A in the manner of a ring in cross-section and is thus here formed as an annular space. In the embodiment variant of FIG. 7A, fuel-swirling means 31 are provided in the direction of the end of the peg-shaped, axially extending flow body 3A (said means may also be omitted by corresponding design of the passage openings 23 according to FIGS. 3A to 3C).

In the design variant of FIG. 7A, the fuel flows onward from the annular space of the first pipe portion 3A through a second pipe portion 3B in the direction of the fuel outlet opening 33, which is formed as a flow space of circular cross section. It is only toward the end of the fuel pipe 3 that the fuel impinges on the further (second) downstream flow body 30B, which in this case is of conical form (with the cone tip pointing toward the first, upstream flow body 30A). The corresponding radially widening form of the conical flow body 30B toward its end 301 causes the fuel outlet opening 33 of the fuel pipe 3 to be narrowed and also conducted radially outward. A blunt or substantially flat end face of the conical second flow body 30B here again faces the combustion space 1030.

In a refinement shown in FIG. 7B, the nozzle D of FIG. 7A is provided—as an alternative to the axial swirling means—with radial swirling means in the radially outermost (second) air-guiding duct 5. Consequently, air coming from the the compressor V radially further out is conducted into the radially outermost second air-guiding duct 5 and distributed accordingly via the radial swirling means 52.

Figure 8:
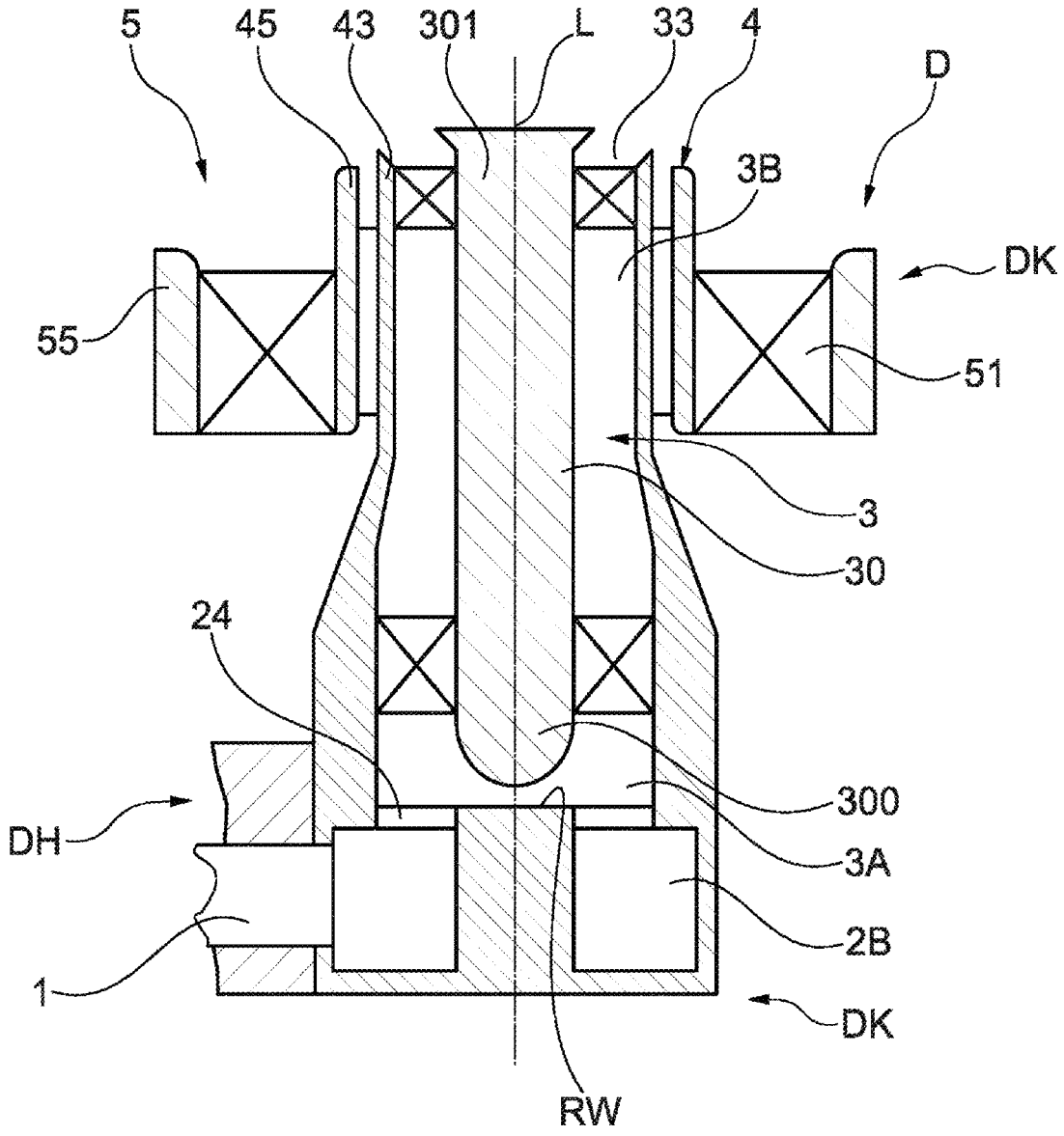
FIG. 8 shows, in a view corresponding to FIGS. 1, 6 and 7A-7B, a further embodiment variant in which, instead of a ring chamber circumferentially surrounding a first pipe portion of the fuel pipe, a ring chamber for the fuel to be supplied is provided lying axially upstream of the first pipe portion.

In the embodiment variant shown in FIG. 8 of a nozzle D of a proposed nozzle assembly, the feed reservoir, into which fuel coming from the fuel feed line 1 is fed, is again formed as a ring chamber 2B. In contrast to the embodiment variants of FIGS. 1 to 7B, here the ring chamber 2B is however arranged upstream of the fuel pipe 3. The ring chamber 2B of FIG. 8 thus does not extend circumferentially around a first pipe portion 3A of the fuel pipe 3, but is axially spaced therefrom. The arrangement of the combustion chamber 2B upstream of the fuel pipe 3 may have the advantage—compared with an embodiment variant from FIGS. 1 to 6—that the nozzle main body DR is slimmer in the head region in which the nozzle main body DR is connected to the nozzle holder DH, and need not be made as thick. The possibly greater length of the nozzle D measured along the nozzle longitudinal axis L is acceptable here.

In operation of the engine T, the fuel thus flows from the ring chamber 2B substantially axially through passage openings 24 in a rear wall RW bordering the fuel pipe 3 upstream, into the first pipe portion 3A of the fuel pipe 3. The passage openings 24 may here be evenly distributed around the nozzle longitudinal axis L in the rear wall RW separating the ring chamber 2B from the first pipe portion 3A. The passage openings 24 may also extend precisely axially through the rear wall RW. Alternatively, evidently here too a refinement is conceivable in which the passage openings 24 run obliquely to the nozzle longitudinal axis L, so that the fuel flow guided through the passage openings 24 has a flow proportion in the circumferential direction U on entry into the fuel pipe 3. In particular, in the latter case, all passage openings 24 formed in the rear wall RW may run obliquely to the nozzle longitudinal axis L at the same angle, wherein in this case the directions of the corresponding oblique axes are each oriented tangentially to a theoretical arc running through the centres of the passage openings 24, in order to generate the desired swirl.

Figure 9:
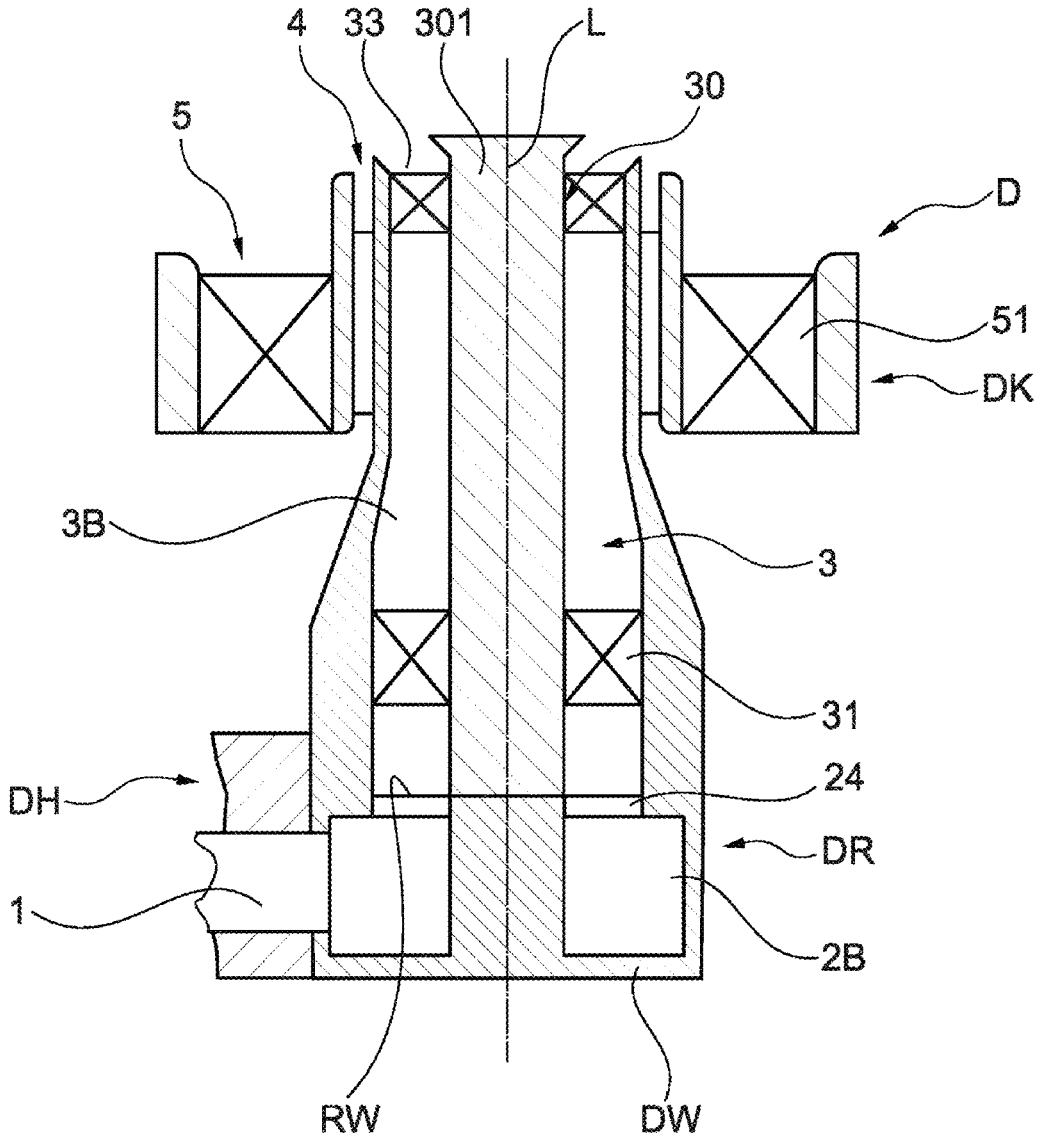
FIG. 9 shows a refinement of the embodiment variant of FIG. 8, in which a central flow body is connected to a rear wall which is inside the nozzle main body and separates the upstream ring chamber from the fuel pipe.

As illustrated in the refinement of FIG. 9, an embodiment variant with feed reservoir in the form of the ring chamber 2B arranged upstream of the fuel pipe 3 also offers the possibility of connecting an individual central flow body 30 (or a first flow body 30A lying upstream according to FIGS. 7A and 7B) to the rear wall RW, and hence in particular to the (hub) portion of the nozzle main body DR about which the ring chamber 2B extends and which is connected to the end wall DW of the nozzle D. Fuel from the ring chamber 2B thus flows substantially axially along the nozzle longitudinal axis L into a ring chamber 3B of the fuel pipe 3 which extends as a ring around this flow body 30A.

In both embodiment variants of FIGS. 8 and 9, the passage openings 24 in the rear wall RW may also be configured for example as holes or slots, and/or differ from one another in their cross-sectional areas.

Figure 10A:
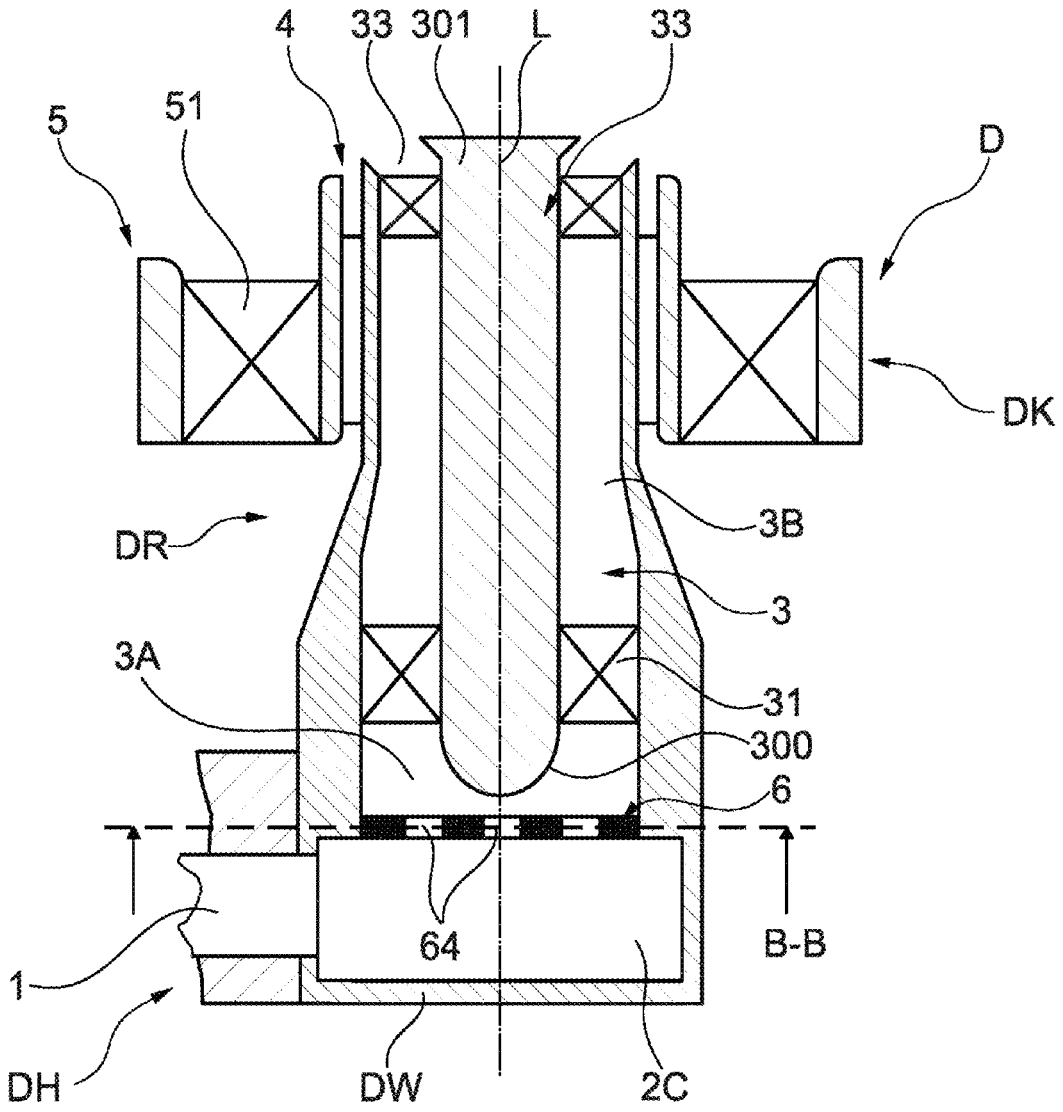
FIG. 10A shows, in a view corresponding in particular to FIG. 1, a further embodiment variant in which, instead of a ring chamber upstream of the fuel pipe, a central cavity is formed for a feed reservoir from which the fuel to be supplied can flow into the fuel pipe substantially in the axial direction via passage openings in a partition wall.
Figure 10B:
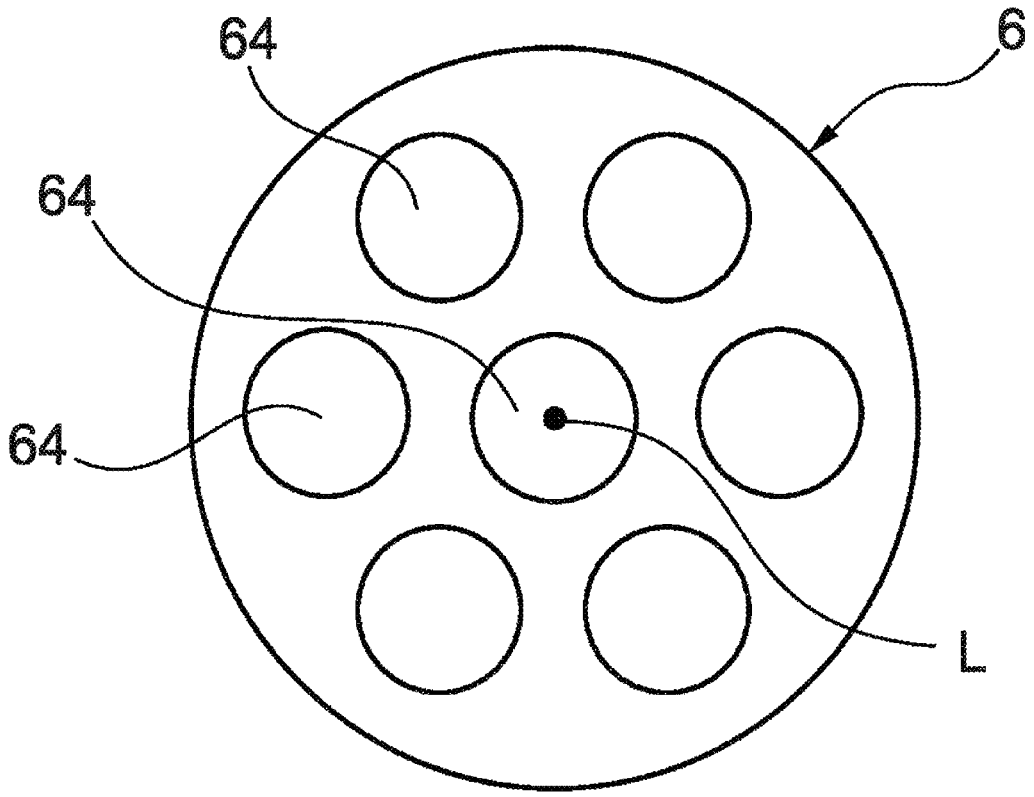
FIG. 10B shows an individual illustration of the partition wall corresponding to section line B-B of FIG. 10A (without showing the adjacent portions of the nozzle)

In the embodiment variants of FIGS. 10A and 10B, the feed reservoir for the fuel coming from the fuel feed line 1 in the head region of the nozzle main body DR is configured as a fuel chamber 2C which is formed by a cavity in the head region. In this case, the fuel chamber 2C has a circular cross-section. In operation of the engine T, the fuel flows from this fuel chamber 2C substantially axially into the fuel pipe 3 which is sealed against an inflow of air. For this, the fuel pipe 3 and the fuel chamber 2C are physically separated from one another by a partition wall 6 which has multiple passage openings 64 for the inflow of fuel from the fuel chamber 2C into the fuel pipe 3. An upstream end 300 of a peg-shaped flow body 30, arranged centrally inside the fuel pipe 3, is here shown axially spaced from the partition wall 6, but could however also be connected thereto.

In principle, in this case, e.g. in FIGS. 1, 6, 8, 10A and 10B, an upstream end 300 of the flow body 30 is shown to be hemispherical. This is however evidently not obligatory. Other geometric shapes are also conceivable, e.g. conical, ogival or ovoid.

The passage openings 64 are regularly distributed on the present disc-shaped partition wall 6, as illustrated for example by the sectional view in FIG. 10B. Thus several passage openings 64 are evenly distributed over the circumference about the nozzle longitudinal axis L. Also, a central passage opening 64 is provided centrally on the partition wall 6, so that a centre axis of the central, here circular passage opening 64 runs coaxially to the nozzle longitudinal axis 11. Thus via the partition wall 6 with evenly distributed passage openings 64, the fuel can be introduced into the fuel pipe 3 as homogenously as possible.

In the illustration of FIG. 10B, the passage openings 64 are shown with identical cross-sectional areas. Here too however, the cross-sectional areas of the passage openings 64 may evidently also differ from one another. Also, again a configuration as slots is possible, as is an extent sloping relative to the nozzle longitudinal axis L, in order to generate a swirling fuel flow even on entry into the fuel pipe 3.

It is self-evident that the proposed solution is not limited to the exemplary embodiments described above, and various modifications and improvements can be made without departing from the concepts described here. Any of the features may be used separately or in combination with any other features, unless they are mutually exclusive, and the disclosure extends to and includes all combinations and subcombinations of one or more features which are described here.

LIST OF DESIGNATIONS

1 Fuel feed line
103 Combustion chamber
1030 Combustion space
111 Low-pressure compressor
112 High-pressure compressor
113 High-pressure turbine
114 Medium-pressure turbine
115 Low-pressure turbine
23, 23.1-23.4 Passage opening
24 Passage opening
2A, 2B Ring chamber (feed reservoir)
2C Fuel chamber (feed reservoir)
3 Fuel pipe
30, 30A, 30B Flow body
300, 301 End
3010 Guide collar (guide element)
31 Fuel-swirling means (swirl element)
33 Fuel outlet opening
3A Pre-chamber/ring space (1st pipe portion)
3B Ring space/flow space (2nd pipe portion)
4 First air-guiding duct/annular gap
43 Inner wall
45 Outer wall
450 Inlet lip
5 Second air-guiding duct
51 Air-swirling means (swirl element)
52 Air-swirling means (swirl element)
55 Outermost wall
550 Inlet lip
6 Partition wall
64 Passage opening
A Outlet
B Bypass duct
b Width
BK Combustion chamber assembly
BR Combustor seal
C Outlet cone
D Nozzle
DH Nozzle holder
DK Nozzle head
DR Nozzle main body
DW End wall
E Inlet/Intake
F Fan
F1, F2 Fluid flow
FC Fan casing
G Outer housing
L Nozzle longitudinal axis
l Length
M Centre axis/Axis of rotation
R Combustion chamber ring
RW Rear wall
S Rotor shaft
T (Turbofan) engine
TT Turbine
U Circumferential direction
V Compressor
W Inner wall

The invention claimed is:

1. A nozzle assembly for a combustion chamber of an engine, comprising:

at least one nozzle for injecting a fuel into a combustion space of the combustion chamber, wherein the at least one nozzle comprises a nozzle main body which extends along a nozzle longitudinal axis and a nozzle holder which is connected to the nozzle main body and has at least one fuel feed line, wherein the nozzle main body comprises a central fuel pipe extending along the nozzle longitudinal axis and sealed against an inflow of air, in which fuel supplied via the at least one fuel feed line is guided within the nozzle main body up to a fuel outlet opening of the fuel pipe which is positioned at a nozzle end of the at least one nozzle and via which the fuel is introduced into the combustion chamber;

wherein the at least one nozzle comprises a feed reservoir which is connected to the at least one fuel feed line and to which the fuel is supplied from the at least one fuel feed line and from which the fuel is supplied to the fuel pipe;

at least one passage opening, via which fuel will flow from the feed reservoir into the fuel pipe;

wherein the at least one passage opening extends through an inner wall of the fuel pipe running around the nozzle longitudinal axis;

wherein the at least one passage opening includes a plurality of passage openings on the inner wall; and wherein at least two of the plurality of passage openings differ from one another with respect to lengths and/or cross-sectional areas thereof.

2. The nozzle assembly as claimed in claim 1, wherein the feed reservoir is provided in a region of the at least one nozzle which is bordered by an end wall of the at least one nozzle situated upstream relative to a flow direction defined by the fuel pipe, along which the fuel is guided within the nozzle main body to the nozzle end.

3. The nozzle assembly as claimed in claim 2, wherein the feed reservoir is formed in a head region of the nozzle main body connected to the nozzle holder.

4. The nozzle assembly as claimed in claim 1, wherein the at least one passage opening is configured for an inflow of fuel from the feed reservoir into a first pipe portion of the fuel pipe in a direction which is substantially radially inward relative to the nozzle longitudinal axis.

5. The nozzle assembly as claimed in claim 1, wherein the at least one passage opening is configured for an inflow of fuel from the feed reservoir into a first pipe portion of the fuel pipe in a direction which is substantially axial relative to the nozzle longitudinal axis.

6. The nozzle assembly as claimed in claim 5, wherein the at least one passage opening extends through a rear wall of the fuel pipe which runs substantially or precisely perpendicularly to the nozzle longitudinal axis and borders the first pipe portion, or through a partition wall separating the feed reservoir from the first pipe portion.

7. The nozzle assembly as claimed in claim 6, wherein the at least one passage opening extends through the rear wall or partition wall along an extent direction which runs obliquely to the nozzle longitudinal axis.

8. The nozzle assembly as claimed in claim 6, wherein the at least one passage opening includes a plurality of passage openings on the rear wall or partition wall.

9. The nozzle assembly as claimed in claim 1, wherein the at least one passage opening is configured and provided for generating a fuel flow in the first pipe portion with a movement component in a circumferential direction about the nozzle longitudinal axis.

10. The nozzle assembly as claimed in claim 1, wherein the at least one passage opening extends through the inner wall along an extent direction which, relative to the nozzle longitudinal axis, runs obliquely or parallel-offset to a radial line oriented perpendicularly to the nozzle longitudinal axis.

11. The nozzle assembly as claimed in claim 1, wherein the feed reservoir is formed as a ring chamber.

12. The nozzle assembly as claimed in claim 11, wherein the at least one centrally arranged flow body is connected to an end wall of the at least one nozzle or a rear wall of the fuel pipe.

13. The nozzle assembly as claimed in claim 1, wherein the feed reservoir is formed via a hollow body arranged centrally upstream of the first pipe portion relative to a flow direction defined by the fuel pipe, along which the fuel is guided within the nozzle main body to the nozzle end.

14. The nozzle assembly as claimed in claim 1, and further comprising, inside the fuel pipe, at least one centrally arranged flow body defining a portion of a flow path for the fuel through the main body.

15. The nozzle assembly as claimed in claim 14, wherein end of the at least one centrally arranged flow body extends up to the nozzle end.

16. The nozzle assembly as claimed in claim 15, wherein the at least one centrally arranged flow body has at an end thereof a guide element, via which the fuel emerging at the fuel outlet opening is conducted radially outward relative to the nozzle longitudinal axis.

17. The nozzle assembly as claimed in claim 14, wherein the at least one centrally arranged flow body is formed in the shape of a peg or cone.

18. The nozzle assembly as claimed in claim 14, wherein the at least one centrally arranged flow body includes two flow bodies, which are axially spaced from one another relative to the nozzle longitudinal axis, are provided inside the fuel pipe.

19. The nozzle assembly as claimed in claim 1, wherein at its nozzle end, the at least one nozzle comprises a nozzle head which is connected to the nozzle main body and has at least one air-guiding duct, via which air provided for mixing with the fuel delivered from the fuel outlet opening is introduced into the combustion space.

20. The nozzle assembly as claimed in claim 19, wherein the at least one air-guiding duct comprises at least one air outlet opening at the nozzle end, and the fuel outlet opening of the fuel pipe protrudes axially beyond the at least one air outlet opening, relative to the nozzle longitudinal axis.

21. The nozzle assembly as claimed in claim 19, wherein the at least one air-guiding duct includes at least two air-guiding ducts, which are radially spaced from one another and each have at least one of the at least one air outlet opening, are provided at the nozzle head.

22. The nozzle assembly as claimed in claim 21, wherein one or more radially inwardly pointing inlet lips are provided at least at a radially outermost air-guiding duct of the at least two air-guiding ducts, to conduct air into the radially outermost air-guiding duct.

23. The nozzle assembly as claimed in claim 21, wherein one or more axial or radial swirling devices for air which is to flow into the combustion space are provided at least in a radially outermost air-guiding duct of the at least two air-guiding ducts.

24. The nozzle assembly as claimed in claim 1, wherein the at least one nozzle is configured and provided for the injection of gaseous fuel.

25. An engine having at least one of the nozzle assembly as claimed in claim 1.

26. A nozzle assembly for a combustion chamber of an engine, comprising:

at least one nozzle for injecting a fuel into a combustion space of the combustion chamber, wherein the at least one nozzle comprises a nozzle main body which extends along a nozzle longitudinal axis and a nozzle holder which is connected to the nozzle main body and has at least one fuel feed line, wherein the nozzle main body comprises a central fuel pipe extending along the nozzle longitudinal axis and sealed against an inflow of air, in which fuel supplied via the at least one fuel feed line is guided within the nozzle main body up to a fuel outlet opening of the fuel pipe which is positioned at a nozzle end of the at least one nozzle and via which the fuel is introduced into the combustion chamber;

wherein the at least one nozzle comprises a feed reservoir which is connected to the at least one fuel feed line and to which the fuel is supplied from the at least one fuel feed line and from which the fuel is supplied to the fuel pipe;

wherein the feed reservoir is formed as a ring chamber and the ring chamber tapers in cross-section towards a portion of a wall which borders the ring chamber on the radial outside and lies opposite a feed opening via which the fuel is supplied from the at least one fuel feed line to the ring chamber.

27. A nozzle assembly for a combustion chamber of an engine, comprising:

at least one nozzle for injecting a fuel into a combustion space of the combustion chamber, wherein the at least one nozzle comprises a nozzle main body which extends along a nozzle longitudinal axis and a nozzle holder which is connected to the nozzle main body and has at least one fuel feed line, wherein the nozzle main body comprises a central fuel pipe extending along the nozzle longitudinal axis and sealed against an inflow of air, in which fuel supplied via the at least one fuel feed line is guided within the nozzle main body up to a fuel outlet opening of the fuel pipe which is positioned at a nozzle end of the at least one nozzle and via which the fuel is introduced into the combustion chamber;

wherein the at least one nozzle comprises a feed reservoir which is connected to the at least one fuel feed line and to which the fuel is supplied from the at least one fuel feed line and from which the fuel is supplied to the fuel pipe;

at least one passage opening, via which fuel will flow from the feed reservoir into the fuel pipe;

wherein the at least one passage opening extends through an inner wall of the fuel pipe running around the nozzle longitudinal axis;

wherein the at least one passage opening includes a plurality of passage openings on the inner wall; and wherein the plurality of passage openings includes a first passage opening and a further passage opening and cross-sectional areas of the first passage opening and the further passage opening increase over the circumference, starting from the first passage opening to the further passage opening, such that equal proportions of a total mass flow of fuel flowing into the ring chamber flow into the first pipe portion via the first passage opening and the further passage opening.

28. The nozzle assembly as claimed in claim 27, wherein the first passage opening faces a feed opening via which the fuel is supplied from the at least one fuel feed line to the ring chamber, and the at least one-further passage opening faces a portion of a wall which borders the ring chamber on the radial outside and lies opposite the feed opening in a cross-sectional view.

* * * * *